US012473132B2

(12) United States Patent
Fuhst

(10) Patent No.: US 12,473,132 B2
(45) Date of Patent: Nov. 18, 2025

(54) PERFORATED PANEL FOR BOTTLE PACKAGING

(71) Applicant: NIAGARA BOTTLING, LLC, Diamond Bar, CA (US)

(72) Inventor: Jason Thomas Fuhst, Upland, CA (US)

(73) Assignee: Niagara Bottling, LLC, Diamond Bar, CA (US)

( * ) Notice: Subject to any disclaimer, the term of this patent is extended or adjusted under 35 U.S.C. 154(b) by 0 days.

(21) Appl. No.: 18/600,193

(22) Filed: Mar. 8, 2024

(65) Prior Publication Data

US 2024/0300715 A1 Sep. 12, 2024

Related U.S. Application Data

(60) Provisional application No. 63/489,313, filed on Mar. 9, 2023.

(51) Int. Cl.
*B65D 75/00* (2006.01)
*B65D 75/54* (2006.01)

(52) U.S. Cl.
CPC ..... *B65D 75/004* (2013.01); *B65D 75/54* (2013.01); *B65D 2203/12* (2013.01); *B65D 2575/54* (2013.01)

(58) Field of Classification Search
CPC ..... B65D 71/08; B65D 71/085; B65D 71/10; B65D 75/00; B65D 75/004; B65D 75/54;
(Continued)

(56) References Cited

U.S. PATENT DOCUMENTS 2,554,841 A 5/1951 Rumsey, Jr.
3,231,083 A 1/1966 Rumsey, Jr.
(Continued)

FOREIGN PATENT DOCUMENTS

EP 0696542 A1 2/1996
EP 1785357 A1 5/2007
(Continued)

OTHER PUBLICATIONS

International Search Report with Written Opinion for related Application No. PCT/US2019/046857 dated Nov. 5, 2019 ( 9 Pages).
(Continued)

*Primary Examiner* — Bryon P Gehman
(74) *Attorney, Agent, or Firm* — Michael Best & Friedrich LLP

(57) ABSTRACT

A perforated panel assembly is disposed in a shrink-wrapped bottle pack. The panel assembly includes a removable panel and an alternating series of cuts and lands bordering a portion of the removable panel. The alternating series of cuts and lands includes a first side perforation defining a first portion and a second portion. The first portion is positioned on a top panel of the bottle pack and the second portion is positioned on a first side of the bottle pack. The alternating series of cuts and lands further includes a second side perforation defining a first portion and a second portion. The first portion is positioned on the top panel of the bottle pack and the second portion is positioned on the first side of the bottle pack. The second portion of the first side perforation is oriented oblique to the first portion of the first side perforation.

11 Claims, 8 Drawing Sheets

(58) Field of Classification Search
CPC ..... B65D 75/58; B65D 75/5838; B65D 2203/12; B65D 2575/54
USPC ..... 206/432, 497
See application file for complete search history.

(56) References Cited

U.S. PATENT DOCUMENTS

| | | | | |
|---|---|---|---|---|
| 3,273,302 | A * | 9/1966 | Walter | B65B 61/02 206/497 |
| 3,338,404 | A | 8/1967 | Becker et al. | |
| 3,396,841 | A | 8/1968 | Copping | |
| 3,442,436 | A | 5/1969 | Kirby, Jr. | |
| 3,747,749 | A | 7/1973 | Brown | |
| 3,764,351 | A | 10/1973 | Whittington et al. | |
| 4,078,659 | A | 3/1978 | Rensner | |
| 4,333,570 | A | 6/1982 | Heider | |
| 4,586,312 | A | 5/1986 | Limousin | |
| 4,871,068 | A | 10/1989 | Dreyfus | |
| 5,036,978 | A | 8/1991 | Frank et al. | |
| 5,048,687 | A | 9/1991 | Suzuki et al. | |
| 5,050,742 | A | 9/1991 | Muckenfuhs | |
| 5,067,612 | A | 11/1991 | Tsuchiya et al. | |
| 5,129,518 | A | 7/1992 | Tanaka et al. | |
| 5,160,030 | A | 11/1992 | Binsfeld | |
| 5,219,229 | A | 6/1993 | Sengewald | |
| 5,666,445 | A | 9/1997 | Conrad et al. | |
| 5,771,662 | A | 6/1998 | Struges et al. | |
| 6,105,776 | A | 8/2000 | Meilhon | |
| 6,145,656 | A | 11/2000 | Marco | |
| 6,213,293 | B1 | 4/2001 | Marco | |
| 6,513,657 | B2 | 2/2003 | Sheehan, Jr. | |
| 6,698,928 | B2 | 3/2004 | Miller | |
| 6,935,491 | B2 | 8/2005 | Marco | |
| 7,392,905 | B2 | 7/2008 | Andersen et al. | |
| 7,832,553 | B2 * | 11/2010 | Hartness | B65D 71/08 206/820 |
| 7,878,328 | B2 | 2/2011 | Dubosq et al. | |
| 7,942,263 | B2 | 5/2011 | Block | |
| 8,002,114 | B2 | 8/2011 | Faber | |
| 8,104,617 | B2 | 1/2012 | Goto et al. | |
| 8,127,925 | B2 | 3/2012 | Block | |
| 8,333,054 | B2 | 12/2012 | Hartl | |
| 8,800,770 | B2 | 8/2014 | Percival et al. | |
| 9,090,389 | B2 | 7/2015 | Kettwig et al. | |
| 9,511,885 | B2 | 12/2016 | Stuhlmann | |
| 9,561,889 | B2 | 2/2017 | Dayrit et al. | |
| 9,776,780 | B2 | 10/2017 | Schloesser et al. | |
| 10,144,567 | B2 | 12/2018 | Schloesser et al. | |
| 10,189,621 | B2 | 1/2019 | Dayrit et al. | |
| 10,202,229 | B2 | 2/2019 | Huerta et al. | |
| 10,259,630 | B2 | 4/2019 | Gatteschi | |
| 10,259,631 | B2 | 4/2019 | Zillges | |
| 10,781,022 | B2 | 9/2020 | Huerta et al. | |
| 11,565,864 | B2 | 1/2023 | Fuhst | |
| 2002/0112982 | A1 | 8/2002 | Stagray et al. | |
| 2002/0157980 | A1 | 10/2002 | Sheehan | |
| 2002/0162766 | A1 | 11/2002 | Saso et al. | |
| 2007/0095697 | A1 | 5/2007 | Auclair et al. | |
| 2008/0264818 | A1 | 10/2008 | Dubosq et al. | |
| 2008/0302692 | A1 | 12/2008 | Dubosq et al. | |
| 2009/0266732 | A1 | 10/2009 | Hartl | |
| 2011/0215016 | A1 | 9/2011 | Block | |
| 2014/0096486 | A1 | 4/2014 | Buchkremer et al. | |
| 2014/0151258 | A1 * | 6/2014 | Vadhar | B65D 23/0878 206/497 |
| 2014/0231493 | A1 | 8/2014 | Andersen et al. | |
| 2015/0197384 | A1 | 7/2015 | Schloesser et al. | |
| 2016/0130059 | A1 | 5/2016 | Andersen et al. | |
| 2016/0264331 | A1 | 9/2016 | Gatteschi | |
| 2017/0066580 | A1 | 3/2017 | Howells et al. | |
| 2018/0065788 | A1 | 3/2018 | Branyon | |
| 2020/0055652 | A1 | 2/2020 | Fuhst | |
| 2020/0331681 | A1 | 10/2020 | Fuhst | |
| 2022/0227532 | A1 | 7/2022 | Doherty et al. | |

FOREIGN PATENT DOCUMENTS

| | | | |
|---|---|---|---|
| EP | 2730515 | B1 | 8/2016 |
| JP | 2015217954 | A | 12/2015 |
| WO | 2019060630 | A1 | 3/2019 |
| WO | 2020037230 | | 2/2020 |

OTHER PUBLICATIONS

International Search Report with Written Opinion for related Application No. PCT/US2021/040174 dated Sep. 30, 2021 (7 Pages).
International Search Report with Written Opinion for related Application No. PCT/US2024/019158 dated Jun. 17, 2024 (14 Pages).

* cited by examiner

PERFORATED PANEL FOR BOTTLE PACKAGING

CROSS-REFERENCE TO RELATED APPLICATIONS

This application claims priority to U.S. Provisional Patent Application No. 63/489,313, filed on Mar. 9, 2023 and entitled PERFORATED PANEL FOR BOTTLE PACKAGING, the entire contents of which is hereby incorporated by reference.

FIELD

The present disclosure relates to packaging for bottles. More specifically, the present disclosure relates to a removable perforated panel of a shrink-wrapped package of bottles. The perforated panel advantageously provides improved access to individual bottles in the shrink-wrapped package while maintaining a structural rigidity of the shrink wrap.

SUMMARY

In one example of an embodiment, a perforated panel assembly is disposed in a shrink-wrapped bottle pack. The panel assembly includes a removable panel and an alternating series of cuts and lands bordering a portion of the removable panel. The alternating series of cuts and lands includes a first side perforation defining a first portion and a second portion. The first portion is positioned on a top panel of the shrink-wrapped bottle pack and the second portion is positioned on a first side of the shrink-wrapped bottle pack. The alternating series of cuts and lands further includes a second side perforation defining a first portion and a second portion. The first portion is positioned on the top panel of the shrink-wrapped bottle pack and the second portion is positioned on the first side of the shrink-wrapped bottle pack. The second portion of the first side perforation is oriented oblique to the first portion of the first side perforation.

In another example of an embodiment, a shrink-wrapped bottle pack includes a plurality of bottles and a perforated panel assembly covering the plurality of bottles. The perforated panel assembly includes a removable panel and an alternating series of cuts and lands bordering a portion of the removable panel. The alternating series of cuts and lands have a side perforation defining a first portion and a second portion. The first portion is positioned on a top panel of the shrink-wrapped bottle pack and the second portion is positioned on a first side of the shrink-wrapped bottle pack. The second portion of the side perforation is oriented oblique to the first portion of the side perforation.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
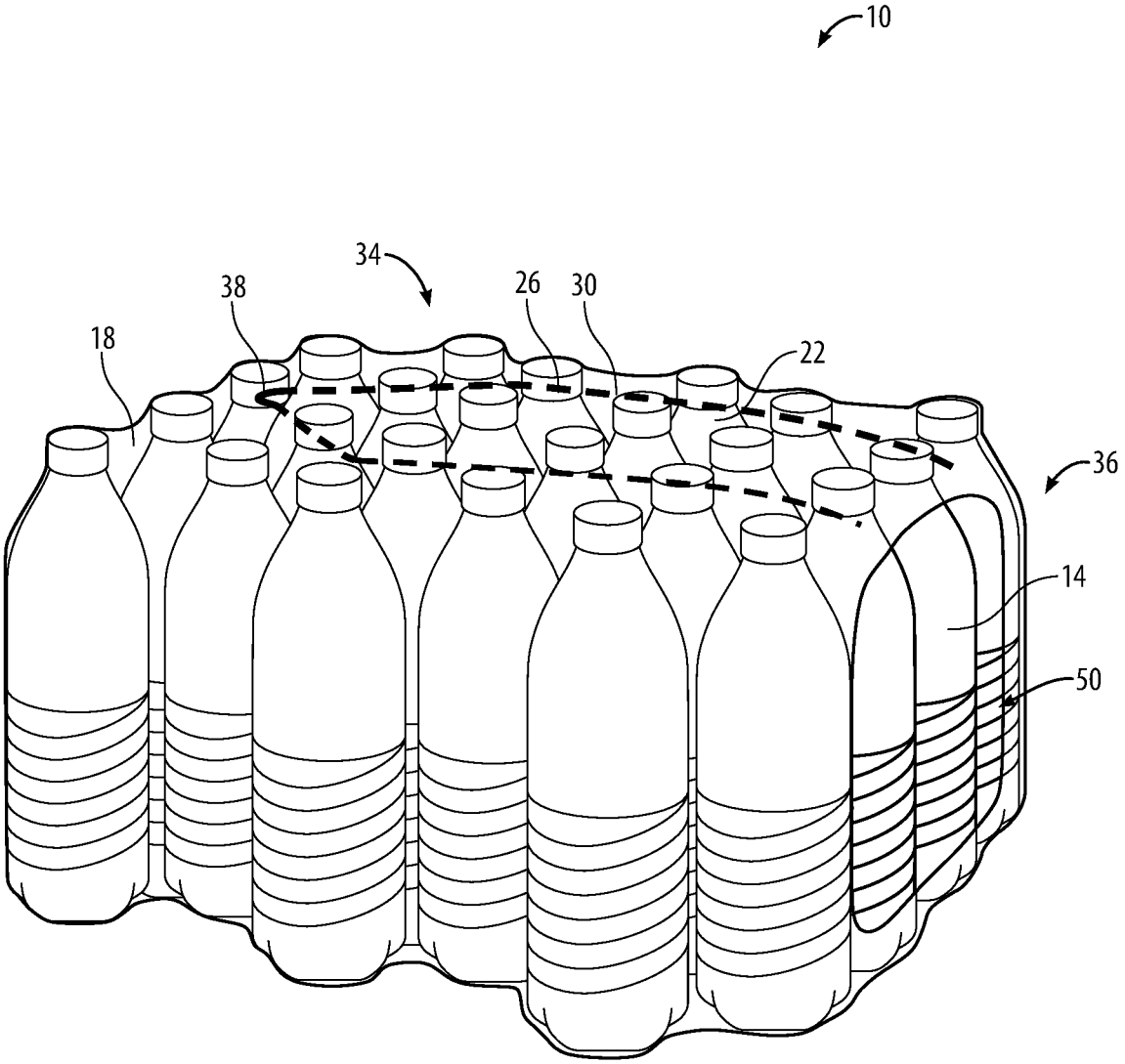
FIG. 1 is a perspective view of an example of an embodiment of a shrink wrapped bottle pack.
Figure 2:
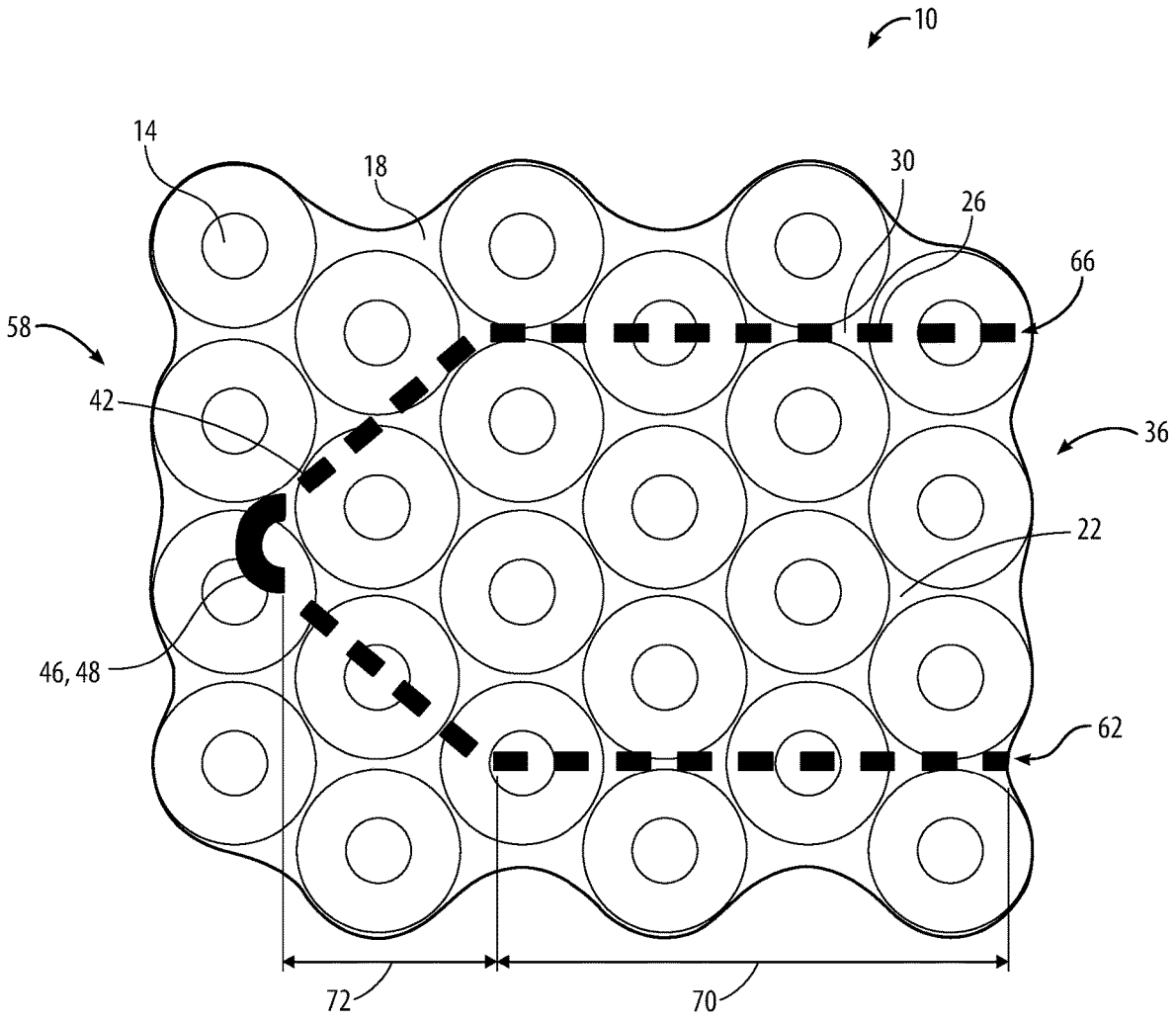
FIG. 2 is a top view of the bottle pack of FIG. 1.

FIGS. 1 and 2 illustrate an example of a shrink-wrapped bottle pack 10. The bottle pack 10 includes a plurality of bottles 14 covered by a perforated panel assembly or shrink wrap 18. In the illustrated embodiment, the bottle pack 10 includes twenty-four (24) bottles 14 arranged in six (6) offset rows of four (4) bottles 14. However, in other examples of embodiments, the bottle pack 10 can include fewer bottles 14 (e.g., 3, 6, 12, etc.) or more bottles 14 (e.g., 36, 48, etc.) in the bottle pack 10. In addition, the bottles 14 can be aligned, offset (or nested), or positioned in any suitable arrangement. The shrink wrap 18 includes a removable perforated panel 22 (also referred to as a removable panel 22). The removable panel 22 is bordered by an alternating series of cuts 26 and lands 30 (collectively referred to as perforations). The removable panel 22 extends from a top panel 34 (or a top side 34) of the bottle pack 10 to a first side 36 (or an end or first end 36) of the bottle pack 10. The bottle pack 10 further includes indicia 38 to identify a location of the removable panel 22. With specific reference to FIG. 2, the illustrated indicia 38 include dashed lines 42 (or broken lines 42) and a rounded portion 46. The illustrated cuts 26 and lands 30 are generally aligned with the dashed lines 42 to provide a visible reference to the user of the approximate position of the perforations. In other examples of embodiments, the cuts 26 and lands 30 can be offset relative to the dashed lines 42 (e.g., positioned inside or outside of the illustrated dashed lines 42). The illustrated rounded portion 46 is semi-circular and defines a customer access portion 48 of the cuts 26 and lands 30. With reference back to FIG. 1, the shrink wrap 18 does not completely envelope the bottles 14. More specifically, the shrink wrap 18 defines a first aperture 50 (or a first window 50) that is located on the first side 36. The bottle pack 10 further includes a second aperture or window (not shown) on a second end 58 (or a second side 58) of the bottle pack 10 (shown in FIG. 2). The second side 58 is positioned opposite the first side 36. In the illustrated embodiment, the second side 58 is positioned closer to the rounded portion 46 of the indicia 38 than the first side 36.

As best illustrated in FIG. 2, the alternating series of cuts 26 and lands 30 include a first side perforation 62 and a second side perforation 66. Each of the first and second side perforations 62, 66 include a linear portion 70 (also referred to as a first portion 70) and an angled portion 72 (also referred to as a third portion 72). Each linear portion 70 extends from the first side 36 towards the second side 58 of the bottle pack 10. The linear portions 70 are arranged parallel to each other. Each angled portion 72 extends from the respective linear portion 70 to meet at the customer access portion 48. Stated another way, the angled portions 72 intersect at the customer access portion 48. The customer access portion 48 then defines an arcuate (or semi-circular or curved) portion. The customer access portion 48 further defines a starting position to facilitate breaking of the cuts 26 and lands 30 (and opening of the removable panel 22). The indicia 38 can direct a user to engage the customer access portion 48. Each angled portion 72 is oriented obliquely relative to the adjacent linear portion 70. In addition, both the linear and angled portions 70, 72 are highlighted (or approximately indicated) by the dashed lines 42. In some embodiments, the first and second side perforations 62, 66 can have a different arrangement or pattern (e.g., zig-zag, curved, etc.). In other examples of embodiments, the linear portion 70 and the angled portion 72 can be collectively referred to as a first portion of each of the first and second side perforations 62, 66. The first portions can extend along the top side 34 of the bottle pack 10 (shown in FIG. 1) between the first side 36 and the customer access portion 48. The alternating series of cuts 26 and lands 30 of the first portion(s) can have any suitable geometry or pattern.

Figure 3:
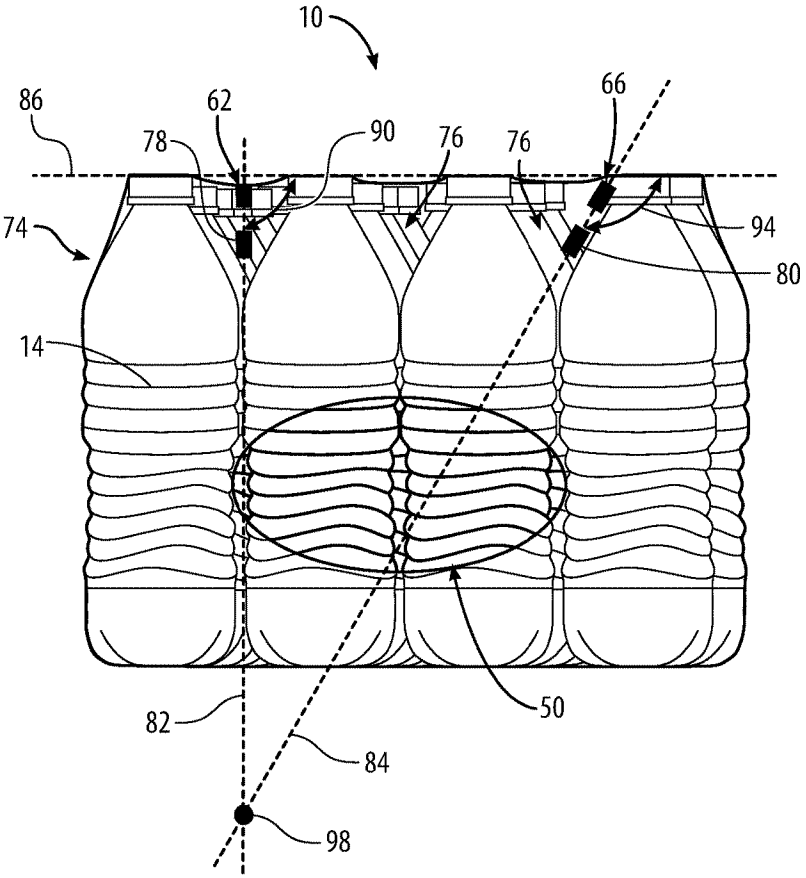
FIG. 3 is a side view of the bottle pack of FIG. 1.

With reference now to FIG. 3, the first and second side perforations 62, 66 on the first side 36 are configured to avoid any portions of the bottles 14, such as a bell 74 of the bottle 14. Adjacent bottles 14 in the bottle pack 10 define a gap 76. The shape of the gap 76 is generally defined between the bell 74 of each adjacent bottle 14. For example, in the illustrated embodiment, each gap 76 resembles a "V" shape defined by the corresponding sloped bell 74 of each bottle 14. In other examples of embodiments, the gaps 76 can have a different shape in response to a different bell 74 curvature, slope, or associated geometry. In order to avoid contact with a portion of the bottle 14 during application of the cuts 26 and lands 30 into the shrink wrap 18, the first and second side perforations 62, 66 are preferably positioned in the gaps 76. More specifically, the first and second side perforations 62, 66 are preferably positioned in the gaps 76 between adjacent bottles 14 in an outer row of bottles 14. The outer row of bottles 14 can be the row of bottles 14 on the first side 36 of the bottle pack 10 (shown in FIG. 2). This is desirable because the first and second side perforations 62, 66 are produced by one or more cutting devices, such as a laser. When producing the perforations, the laser can inadvertently contact a portion of the bottles 14 while cutting through the shrink wrap, which can cause undesirable bottle blemishes or visual defects. To minimize inadvertent contact with the bottles 14, the first and second side perforations 62, 66 each include a second portion 78, 80. While the first portion of the side perforations 62, 66 are positioned on a top side 34 of the bottle pack 10, the second portion 78, 80 of the side perforations 62, 66 are positioned on the first side 36 of the bottle pack 10. Each second portion can include a geometry to facilitate positioning within the gaps 76. It should be appreciated that the second portion 78, 80 of each respective first and second side perforations 62, 66 extend from the top side 34 towards the first window 50, terminating prior to the first window 50. This allows for opening of the removable panel 22 without fully removing the panel 22 from the shrink wrap 18. In other examples of embodiments, the first and second side perforations 62, 66 can extend all the way to the first window 50 to facilitate selective removal of the panel 22 form the shrink wrap 18. It should be appreciated that the rounded portion 46 can be divided into two halves, with one half adjacent each angled portion 72.

FIGS. 3-8 illustrate examples of embodiments of the geometry of the second portions 78, 80 of each of the first and second side perforations 62, 66. For purposes of illustration, in each embodiment, the second portion 78 of the first side perforation 62 defines a first plane 82. The second portion 80 of the second side perforation 66 defines a second plane 84. The top side 34 of the bottle pack 10 defines a top plane 86. The first plane 82 and the top plane 86 define a first angle 90, measured clockwise from the top plane 86 to the first plane 82. The second plane 84 and the top plane 86 define a second angle 94, measured clockwise from the top plane 86 to the second plane 84. In the embodiments shown in FIGS. 3-8, the first and second planes 82, 84 are non-parallel to each other. In these non-parallel orientations, the first and second planes 82, 84 intersect at an intersection point 98. It should be appreciated that the first, second, and top planes 82, 84, 86 are imaginary planes and the intersection point 98 is an imaginary point. In some embodiments, such as FIGS. 9 and 10, the first and second planes 82, 84 are parallel, such that the first and second angles 90, 94 are identical. The respective second portions 78, 80 of the first and second side perforations 62, 66 are obliquely oriented relative to the respective linear portions 70 of the first and second side perforations 62, 66. The first and second angles 90, 94 may be acute or obtuse. It should be appreciated that any feature described with respect to one embodiment of FIGS. 3-8 can be incorporated in any of the other embodiments of FIGS. 3-8.

With specific reference to FIG. 3, in this example of an embodiment, the second portion 78 of the first side perforation 62 is aligned with the linear portion 70 of the first side perforation 62. The second portion 80 of the second side perforation 66 is oriented obliquely relative to the linear portion 70 of the second side perforation 66. Stated another way, the first angle 90 is orthogonal, such that the first plane 82 is aligned with the linear portion 70 of the first side perforation 62 on the top side 34 of the bottle pack 10 (FIG. 2), and the second angle 94 is obtuse. As such, the second plane 84 is oriented obliquely relative to first plane 82. The second portion 78 of the first side perforation 66 is oriented parallel with longitudinal axes (not shown) defined by each bottle 14. The second portion 80 of the second side perforation 66 is oriented obliquely to the longitudinal axis of each bottle 14. However, the second portion 80 of the second side perforation 66 is parallel with the bell 74 of the adjacent bottle 14. It should be appreciated that the second portion 80 of the second side perforation 66 is positioned in the gap 76 between two adjacent bottles 14 on the first side 36 (shown in FIG. 2) of the bottle pack 10. As such, the second portion 80 is spaced apart from the bell 74 of each adjacent bottle 14 and does not overlap with any portion of the adjacent bottles 14. The illustrated intersection point 98 is located below the bottle pack 10. Stated another way, the intersection point 98 is positioned below a bottom surface of the bottle pack 10. In some embodiments, intersection point 98 may be located within the bottle pack 10. It should be appreciated that each bottle 14 has an associated longitudinal axis. Each longitudinal axis extends through a central portion of each bottle 14, through a base and a cap. The longitudinal axis of each bottle 14 is generally centrally located, around which a bottle sidewall is concentrically positioned.

Figure 4:
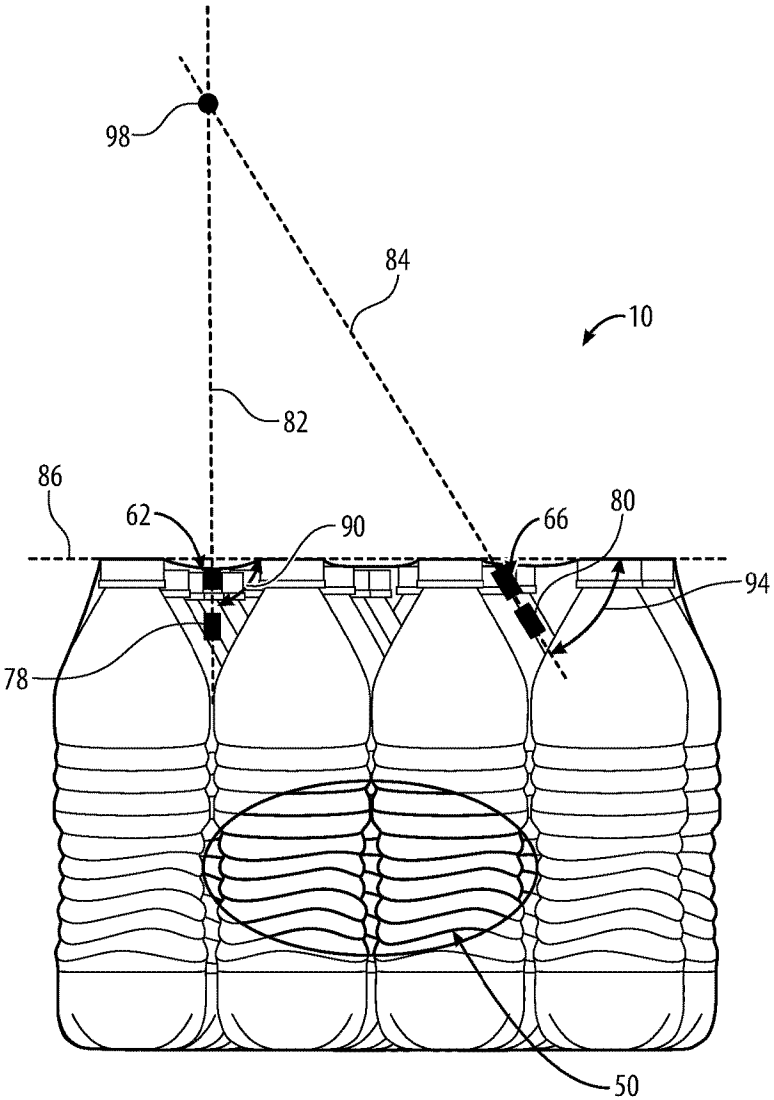
FIG. 4 is a side view of another example of an embodiment of the bottle pack of FIG. 1.

With reference to FIG. 4, in this example of an embodiment, the second portion 78 of the first side perforation 62 is aligned with the linear portion 70 of the first side perforation 62. The second portion 80 of the second side perforation 66 is oriented obliquely relative to the linear portion 70 of the second side perforation 66. Stated another way, the first angle 90 is orthogonal, such that the first plane 82 is aligned with the linear portion 70 of the first side perforation 62 (FIG. 2), and the second angle 94 is acute. As such, the second plane 84 is oriented obliquely relative to first plane 82. The illustrated intersection point 98 is located above the bottle pack 10. Stated another way, the intersection point is positioned above a top surface of the bottle pack 10. In some embodiments, intersection point 98 may be located within the bottle pack 10.

Figure 5:
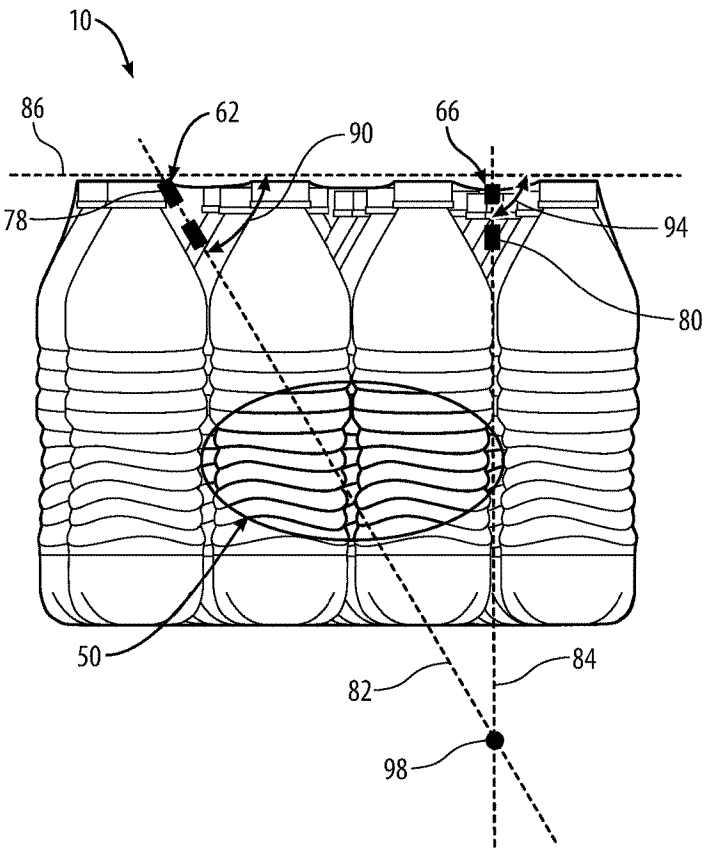
FIG. 5 is a side view of another example of an embodiment of the bottle pack of FIG. 1.

With reference to FIG. 5, in this example of an embodiment, the second portion 78 of the first side perforation 62 is oriented obliquely relative to the linear portion 70 of the first side perforation 62. The second portion 80 of the second side perforation 66 is aligned with the linear portion 70 of the second side perforation 66. Stated another way, the first angle 90 is acute, and the second angle 94 is orthogonal, such that the second plane 84 is aligned with the linear portion 70 of the second side perforation 66 on the top side 34 of the bottle pack 10 (FIG. 2). As such, the first plane 82 is oriented obliquely relative to the second plane 84. The illustrated intersection point 98 is located below the bottle pack 10. In some embodiments, intersection point 98 may be located within the bottle pack 10.

Figure 6:
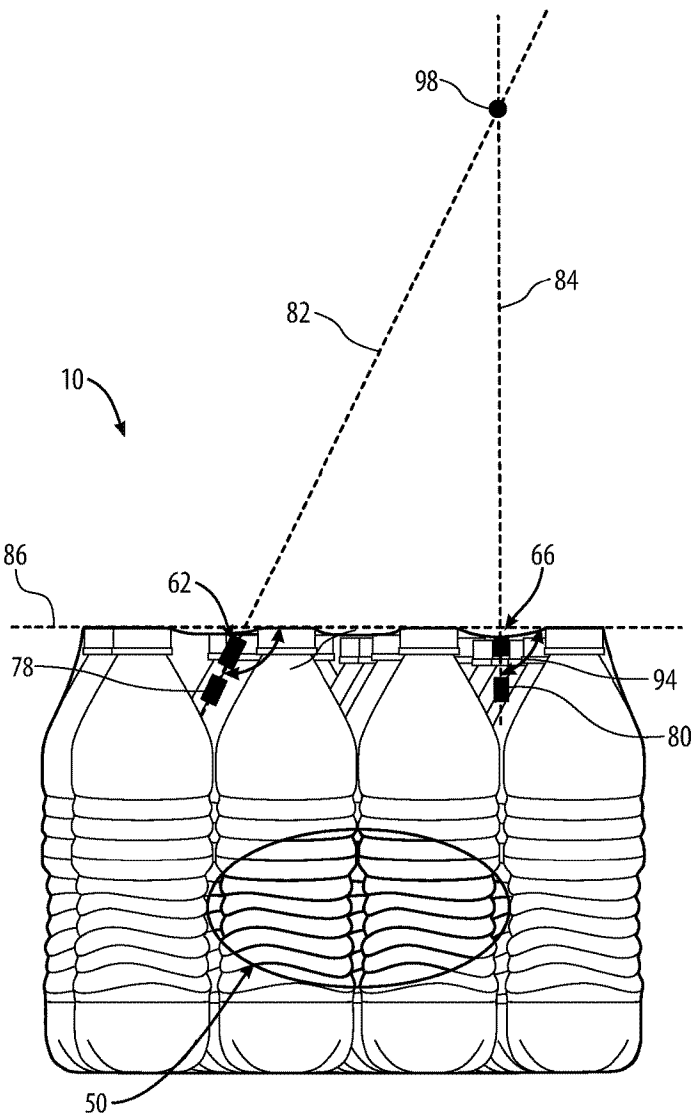
FIG. 6 is a side view of another example of an embodiment of the bottle pack of FIG. 1.

With reference to FIG. 6, in this example of an embodiment, the second portion 78 of the first side perforation 62 is oriented obliquely relative to the linear portion 70 of the first side perforation 62. The second portion 80 of the second side perforation 66 is aligned with the linear portion 70 of the second side perforation 66. Stated another way, the first angle 90 is obtuse, and the second angle 94 is orthogonal such that the second plane 84 is aligned with the linear portion 70 of the second side perforation 66. As such, the first plane 82 is oriented obliquely relative to the second plane 84. The illustrated intersection point 98 is located above the bottle pack 10. In some embodiments, intersection point 98 can be located within the bottle pack 10.

Figure 7:
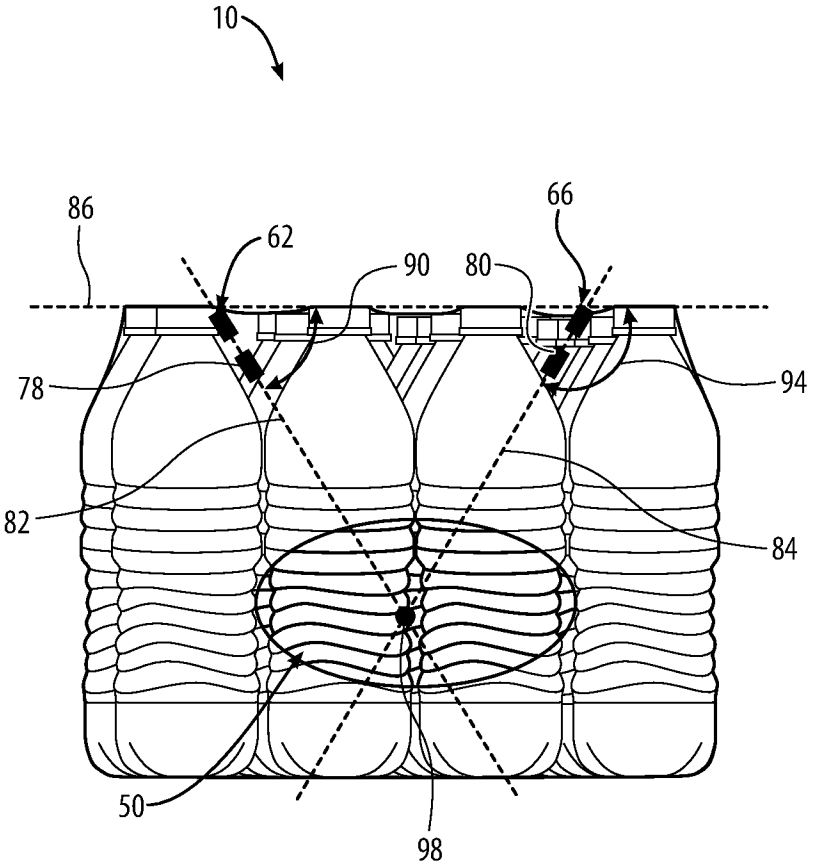
FIG. 7 is a side view of another example of an embodiment of the bottle pack of FIG. 1.

With reference to FIG. 7, in this example of an embodiment, the second portion 78 of the first side perforation 62 is oriented obliquely relative to the linear portion 70 of the first side perforation 62. The second portion 80 of the second side perforation 66 is also oriented obliquely relative to the linear portion 70 of the second side perforation 66. Stated another way, the first angle 90 is acute, and the second angle 94 is obtuse, such that neither the first plane 82 nor the second plane 84 are aligned with the linear portions 70 of the respective first or second side perforations 62, 66. As such, the first plane 82 is oriented obliquely relative to the second plane 84. The illustrated intersection point 98 is located within the bottle pack 10. In some embodiments, the intersection point 98 can be located below the bottle pack 10.

Figure 8:
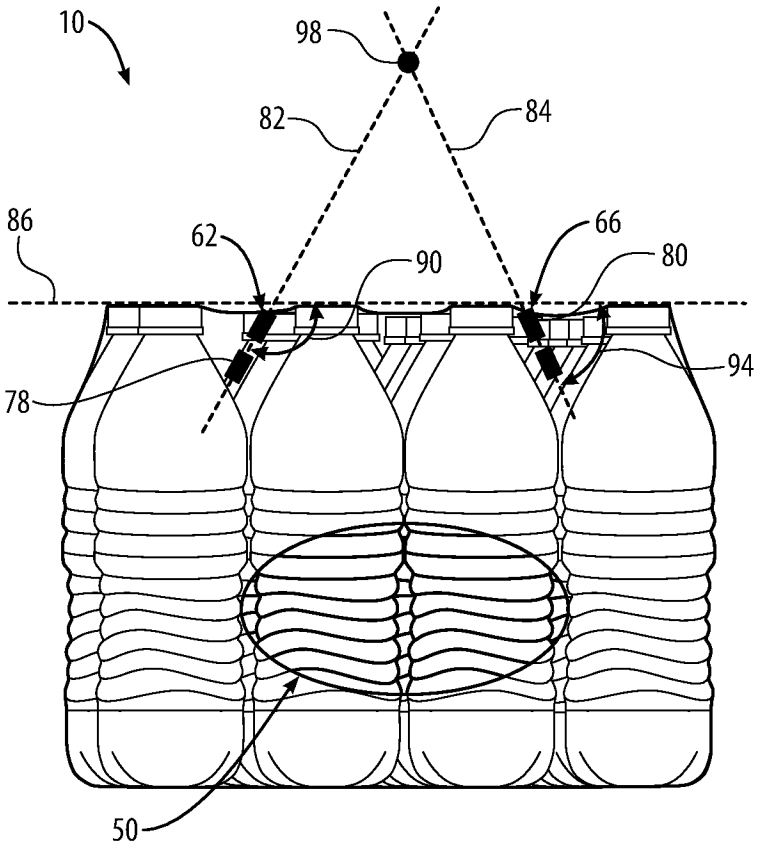
FIG. 8 is a side view of another example of an embodiment of the bottle pack of FIG. 1.

With reference to FIG. 8, in this example of an embodiment, the second portion 78 of the first side perforation 62 is oriented obliquely relative to the linear portion 70 of the first side perforation 62. The second portion 80 of the second side perforation 66 is also oriented obliquely relative to the linear portion 70 of the second side perforation 66. Stated another way, the first angle 90 is obtuse, and the second angle 94 is acute, such that neither the first plane 82 nor the second plane 84 are aligned with the linear portions 70 of the respective first or second side perforations 62, 66. As such, the first plane 82 is oriented obliquely relative to the second plane 84. The illustrated intersection point 98 is located above the bottle pack 10. In some embodiments, the intersection point 98 can be located within the bottle pack 10.

Figure 9:
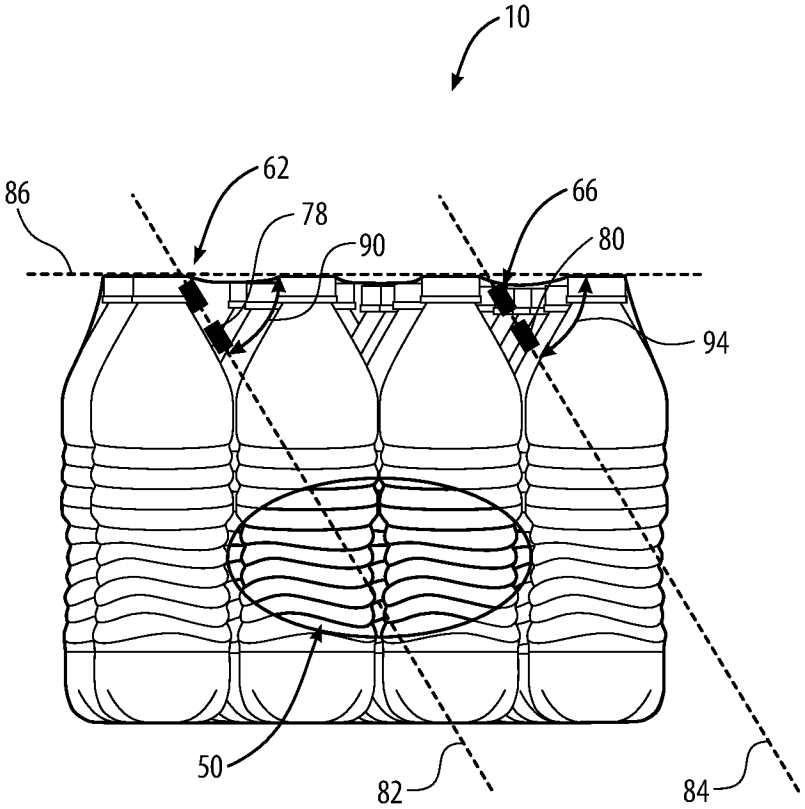
FIG. 9 is a side view of another example of an embodiment of the bottle pack of FIG. 1.

With reference to FIG. 9, in this example of an embodiment, the second portion 78 of the first side perforation 62 is oriented obliquely relative to the linear portion 70 of the first side perforation 62. The second portion 80 of the second side perforation 66 is also oriented obliquely relative to the linear portion 70 of the second side perforation 66. Stated another way, the first angle 90 is acute and the second angle 94 is acute, such that neither the first plane 82 nor the second plane 84 are aligned with the linear portions 70 of the respective first of second side perforations 62, 66. The illustrated first and second angles 90, 94 are equal. As such, the first and second planes 82, 84 are oriented parallel. In some embodiments, the first and second planes 82, 84 can be oriented a few degrees off from being parallel, and thus can be intersecting planes 82, 84.

Figure 10:
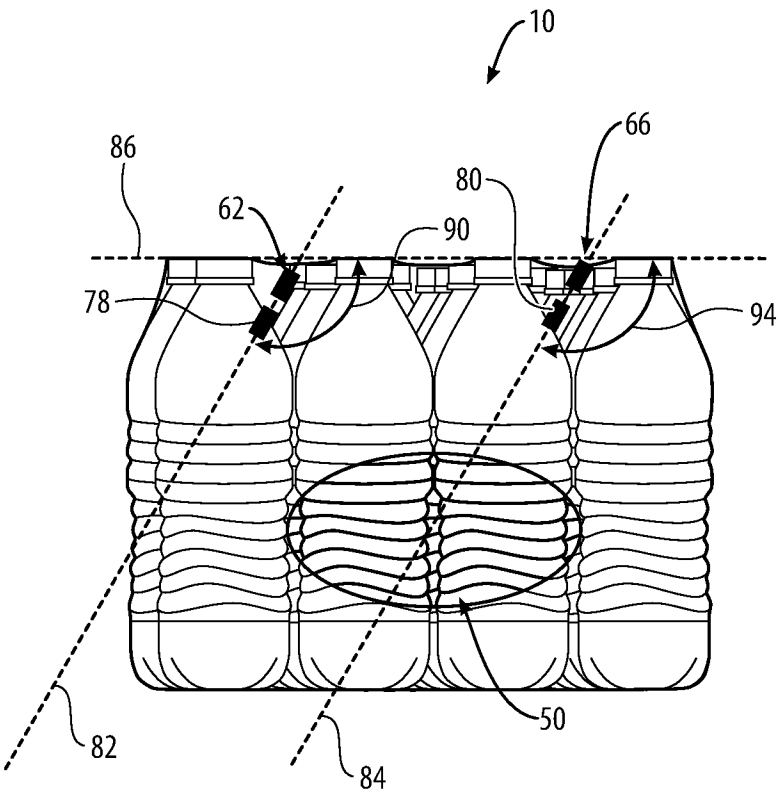
FIG. 10 is a side view of another example of an embodiment of the bottle pack of FIG. 1.

With reference to FIG. 10, in this example of an embodiment, the second portion 78 of the first side perforation 62 is oriented obliquely relative to the linear portion 70 of the first side perforation 62. The second portion 80 of the second side perforation 66 is also oriented obliquely relative to the linear portion 70 of the second side perforation 66. Stated another way, the first angle 90 is obtuse and the second angle 94 is obtuse, such that neither the first plane 82 nor the second plane 84 are aligned with the linear portions 70 of the respective first of second side perforations 62, 66. The illustrated first and second angles 90, 94 are equal. As such, the first and second planes 82, 84 are oriented parallel. In some embodiments, the first and second planes 82, 84 can be oriented a few degrees off from being parallel, and thus can be intersecting planes 82, 84.

Figure 12:
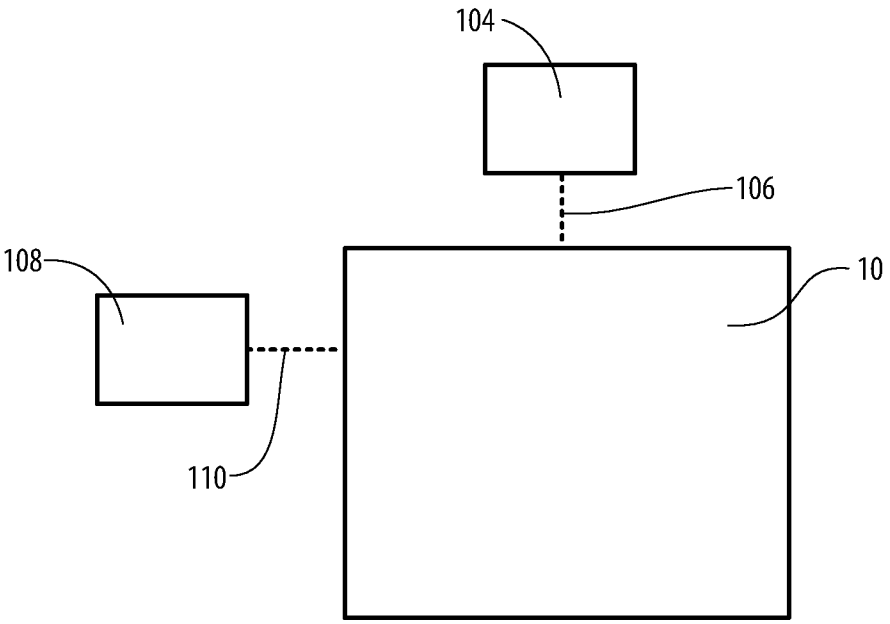
FIG. 12 is a schematic side view of the system of FIG. 11 further illustrating the cutting lasers relative to the bottle pack.
Figure 11:
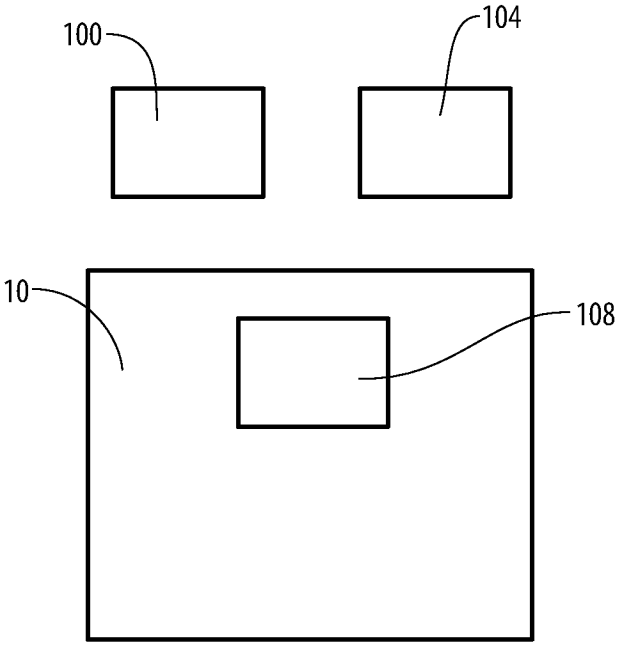
FIG. 11 is a schematic end view of an embodiment of a system for forming perforations in the bottle pack of FIG. 1, the system including plurality of cutting lasers relative to the bottle pack.

FIGS. 11 and 12 illustrate a system for forming the perforations in the bottle pack 10. The system can include a plurality of lasers configured to apply perforations to shrink wrap 18 that defines the bottle pack 10. In the illustrated embodiment, the plurality of lasers include a first top laser 100, a second top laser 104, and a side laser 108. The first and second top lasers 100, 104 are oriented in a direction facing the top side 34 of the bottle pack 10. The first and second top lasers 100, 104 are oriented to emit their respective laser in a top laser plane 106, which is oriented generally orthogonal to the top side 34 of the bottle pack 10. The first top laser 100 is configured to apply the first portion of the first side perforation 62 to the bottle pack 10. The second top laser 104 is configured to apply the first portion of the second side perforation 66 to the bottle pack 10. The side laser 108 is oriented in a direction facing the first side 36 of the bottle pack 10. The side laser 108 is oriented to emit the laser in a side laser plane 110. The side laser plane 110 is oriented generally orthogonal with the first side 36 of the bottle pack 10. The side laser plane 110 is also oriented generally orthogonal to the top laser plane 106. However, in other examples of embodiments, the side laser plane 110 can be oriented at an oblique angle to the top laser plane 106. The side laser 108 is configured to apply the second portion 78 of the first side perforation 62 and the second portion 80 of the second side perforation 66 to the bottle pack 10. In some embodiments, there can be fewer lasers (i.e., two lasers, one top and one side), or more than three lasers.

Figure 13:
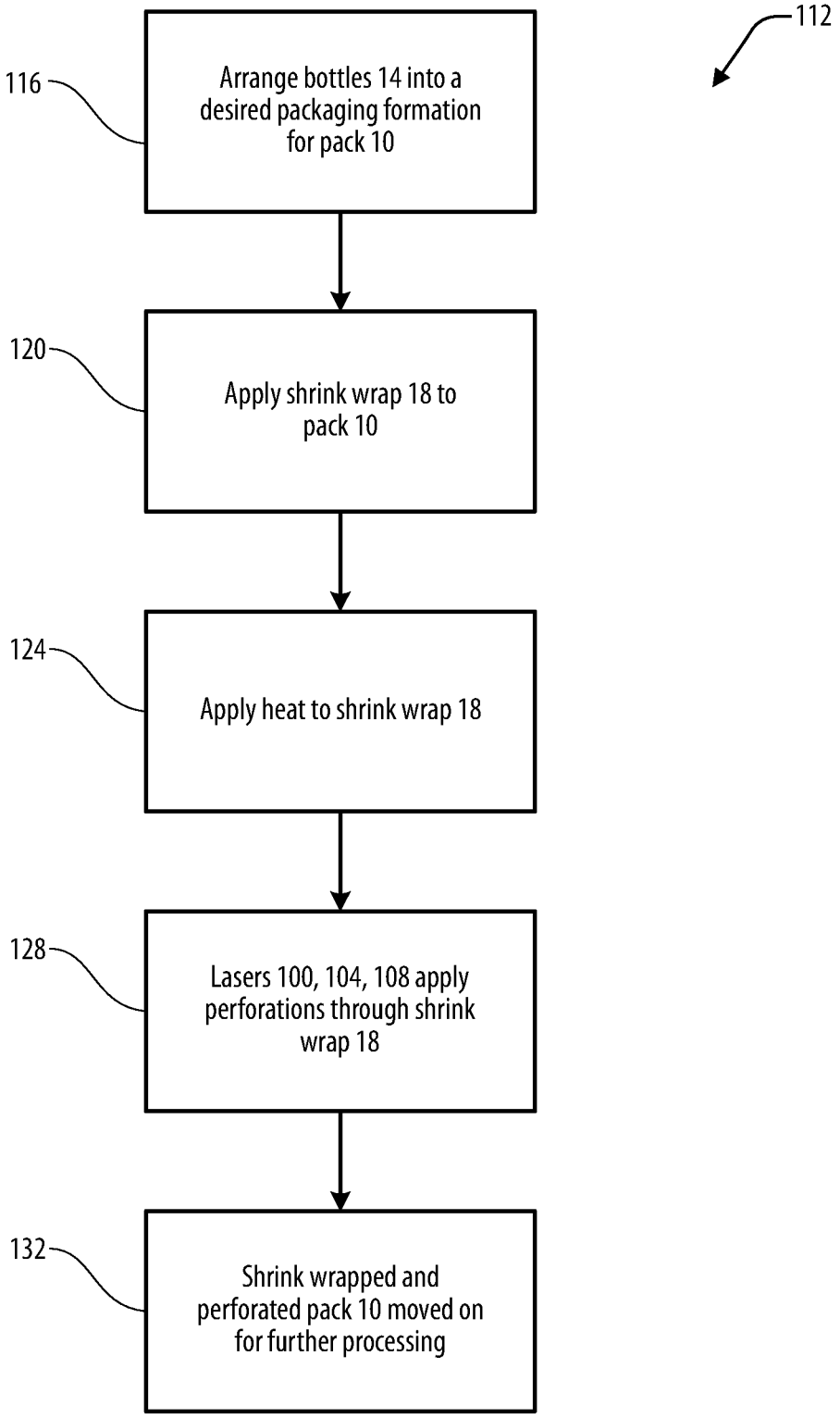
FIG. 13 is a schematic diagram of an example of a method of production of the bottle pack of FIG. 1.

FIG. 13 illustrates a method of manufacturing a shrink wrap package with perforations 112. At step 116 the bottles 14 are arranged in a desired packaging formation. For example, in the illustrated embodiment, the bottles 14 are arranged into six (6) offset rows of four (4) bottles 14. In some embodiments, the bottles 14 can be physically aligned (by one or more arms on a conveyor, etc.) or otherwise held together prior to application of shrink wrap 18 (e.g., placed in a tray, etc.). The arranged bottles 14 are then moved (e.g., by a conveyor belt) to a next location to begin step 120.

At step 120 the arranged bottles 14 are wrapped with the shrink wrap 18, which is generally stored in a roll format. As such, the shrink wrap 18 is unrolled from the roll, and a sheet of the shrink wrap 18 is wrapped around the bottles 14. The bottle pack 10 includes the bottles 14 loosely wrapped in shrink wrap 18. The bottle pack 10 then travels to a heat source, such as a shrink wrap tunnel, to begin step 124.

At step 124, heat is applied to the shrink wrap 18, which causes the shrink wrap 18 to mold to the shape of the bottles 14 and secure the bottles 14 within the bottle pack 10. The shrink wrapped bottle pack 10 then travels to a next location for formation of the perforations at step 128.

At step 128, the cuts 26 and lands 30 are applied by the plurality of lasers 100, 104, 108 to the bottle pack 10 to form the removable panel 22. As the bottle pack 10 travels under the first and second top lasers 100, 104, such as along a conveyor, the first and second top lasers 100, 104 cut the respective first portions of the first and second side perforations 62, 66. Concurrently, or shortly afterwards, the side laser 108 cuts the respective second portions 78, 80 of the first and second side perforations 62, 66. In some embodiments, the side laser 108 can cut the bottle pack 10 before the first and second top lasers 100, 104. The lasers are configured to cut through the shrink wrap 18 but are arranged to avoid contact with the bottles 14. In some embodiments, a single top laser can facilitate formation of the first portions of the first and second side perforations 62, 66.

After formation of the perforations, the bottle pack 10 travels to a next location to begin step 132, which includes further processing (e.g., stacked on a pallet, etc.).

The bottle pack 10 is operated by first pulling on the customer access portion 48, such that the lands 30 in the customer access portion 48 are broken (e.g., ripped), and the customer access portion 48 becomes a tab protruding from the top side 34. The tab is then pulled in a direction toward the first side 36, which will break the lands 30 on the linear and angled portions 70, 72 of the first and second side perforations 62, 66 on the top side 34. The tab may be pulled further in a direction away from the bottle pack 10, which will break the lands 30 on the first and second side perforations 62, 66 on the first side 36. At this moment, every land 30 has been broken on the shrink wrap 18 and an opening to the bottle pack 10 extends from the top side 34 to the first side 36. The removable panel 22 is still attached to the bottle pack 10, due to the first and second side perforations 62, 66 terminating before the first window 50.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A perforated panel assembly disposed in a shrink-wrapped bottle pack, the panel assembly comprising:

a customer access portion positioned on a top panel of the shrink-wrapped bottle pack and configured to facilitate removal of at least a portion thereof; and alternating series of cuts and lands extending from the access portion, the alternating series of cuts and lands including:

a first side perforation defining a first portion and a second portion, the first portion positioned on the top panel of the shrink-wrapped bottle pack and the second portion oriented in a first plane and positioned on a first side of the shrink-wrapped bottle pack; and a second side perforation defining a first portion and a second portion, the first portion positioned on the top panel of the shrink-wrapped bottle pack and the second portion oriented in a second plane and positioned on the first side of the shrink-wrapped bottle pack, wherein the first plane is oriented to intersect the second plane at an imaginary point positioned external to a surface of the shrink-wrapped bottle pack.

2. The perforated panel assembly of claim 1, wherein the first plane is oriented to intersect the second plane at an imaginary point positioned below a bottom surface of the shrink-wrapped bottle pack.

3. The perforated panel assembly of claim 1, wherein the first plane is oriented to intersect the second plane at an imaginary point positioned above a top surface of the shrink-wrapped bottle pack.

4. The perforated panel assembly of claim 1, further comprising an aperture positioned on the first side, the second portion of the first side perforation extends from the top panel to the first side, terminating prior to the aperture.

5. The perforated panel assembly of claim 4, wherein the second portion of the second side perforation extends from the top panel to the first side, terminating prior to the aperture.

6. The perforated panel assembly of claim 1, wherein the shrink-wrapped bottle pack includes a row of bottles on the first side, adjacent bottles in the row of bottles define a gap therebetween, and the second portion of the first side perforation is positioned in the gap.

7. A shrink-wrapped bottle pack comprising:

a plurality of bottles; and a perforated panel assembly covering the plurality of bottles, the perforated panel assembly including:

a customer access portion positioned on a top panel of the shrink-wrapped bottle pack and configured to facilitate removal of at least a portion thereof, the access portion located nearer a first side of the shrink-wrapped bottle pack than to an opposing second side of the shrink-wrapped bottle pack; and alternating series of cuts and lands extending from the access portion, the alternating series of cuts and lands having a side perforation defining a first portion and a second portion, the first portion positioned on the top panel of the shrink-wrapped bottle pack and the second portion positioned on the second side of the shrink-wrapped bottle pack, wherein the second portion of the side perforation is oriented oblique to the first portion of the side perforation.

8. The shrink-wrapped bottle pack of claim 7, wherein the side perforation is a first side perforation, and wherein the alternating series of cuts and lands further comprise a second side perforation defining a first portion and a second portion, the first portion positioned on the top panel of the shrink-wrapped bottle pack and the second portion positioned on the second side of the shrink-wrapped bottle pack.

9. The shrink-wrapped bottle pack of claim 8, wherein the second portion of the second side perforation is oriented oblique to the first portion of the second side perforation.

10. The shrink-wrapped bottle pack of claim 8, wherein the second portion of the first side perforation is parallel with the second portion of the second side perforation.

11. A perforated panel assembly disposed in a shrink-wrapped bottle pack, the panel assembly comprising:

a customer access portion positioned on a top panel of the shrink-wrapped bottle pack and configured to facilitate removal of at least a portion thereof; and alternating series of cuts and lands extending from the customer access portion, the alternating series of cuts and lands including:

a first side perforation defining a first portion and a second portion, the first portion positioned on the top panel of the shrink-wrapped bottle pack and the second portion oriented in a first plane and positioned on a first side of the shrink-wrapped bottle pack; and a second side perforation defining a first portion and a second portion, the first portion positioned on the top panel of the shrink-wrapped bottle pack and the second portion oriented in a second plane and positioned on the first side of the shrink-wrapped bottle pack, wherein the first plane is oriented to intersect the second plane at an imaginary point positioned on the first side of the shrink-wrapped bottle pack.

* * * * *